US005153480A

United States Patent [19]

Schoenherr et al.

[11] Patent Number: 5,153,480

[45] Date of Patent: Oct. 6, 1992

[54] VIBRATION, SHOCK AND HEAT-RESISTANT LAMP-BASE COMBINATION STRUCTURE

[75] Inventors: Walter Schoenherr, Giengen; Alfred Braun; Hermann Steiner, both of Herbrechtingen, all of Fed. Rep. of Germany

[73] Assignee: Patent Treuhand Gesellschaft für elektrische Glühlampen mbH, Munich, Fed. Rep. of Germany

[21] Appl. No.: 726,975

[22] Filed: Jul. 8, 1991

[30] Foreign Application Priority Data

Aug. 2, 1990 [DE] Fed. Rep. of Germany ... 9011351[U]

[51] Int. Cl.[5] ..... H01J 5/48; H01J 5/50

[52] U.S. Cl. ..... 313/269; 313/318; 313/579

[58] Field of Search ..... 313/318, 43, 269, 579; 362/306, 390

[56] References Cited

U.S. PATENT DOCUMENTS 4,463,278 7/1984 Kosmatka et al. ..... 313/318
4,740,876 4/1988 Roller ..... 362/306 X
4,751,421 6/1988 Braun et al. ..... 313/318
4,769,574 9/1988 Nagasawa et al. ..... 313/318
5,041,955 8/1991 Devir et al. ..... 313/318 X

*Primary Examiner*—Palmer C. DeMeo
*Attorney, Agent, or Firm*—Frishauf, Holtz, Goodman & Woodward

[57] ABSTRACT

To improve shock and vibration resistance and heat dissipation of an attachment element (1) coupling the pinch seal (3) of a halogen incandescent lamp (2) to a plastic base (6), the attachment element is formed of two identical half-sections, surrounding the pinch seal in the shape of a cuff (4) and connected to a flange or skirt by an intermediate heat dissipation and shock absorbing portion (7, 11, 12, 13, 14). Preferably, the intermediate portion forms a connecting section, which can be bent into U or double U configuration off the upper region of the flange or skirt portion (8*a*, 8*b*), to provide a large heat radiating surface while retaining the pinch seal of the lamp between undulating sheet-metal portions. Preferably, the attachment element is made of unitary sections of high-quality specialty steel.

20 Claims, 4 Drawing Sheets

FIG. 2
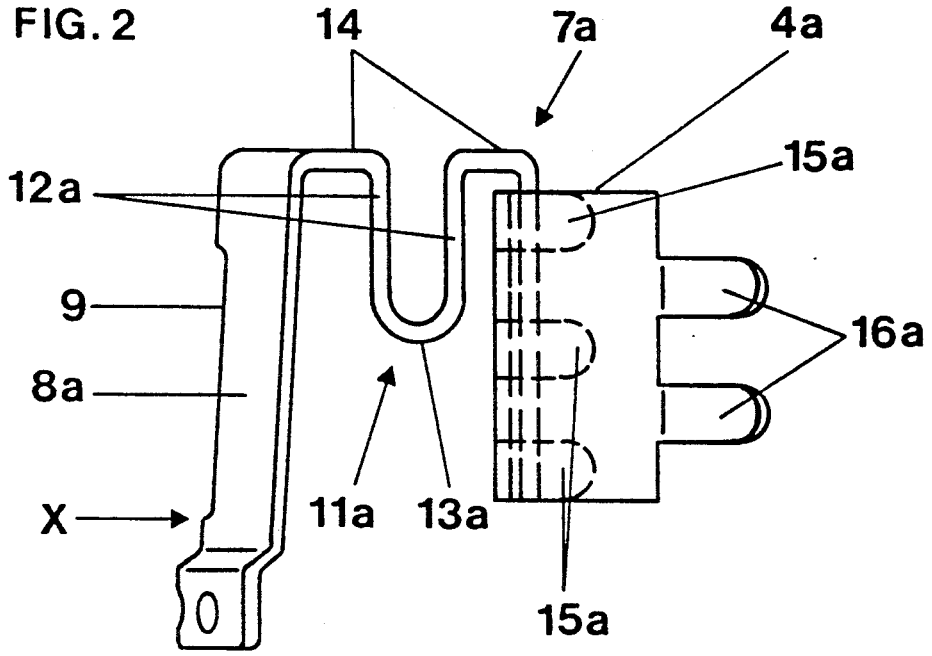
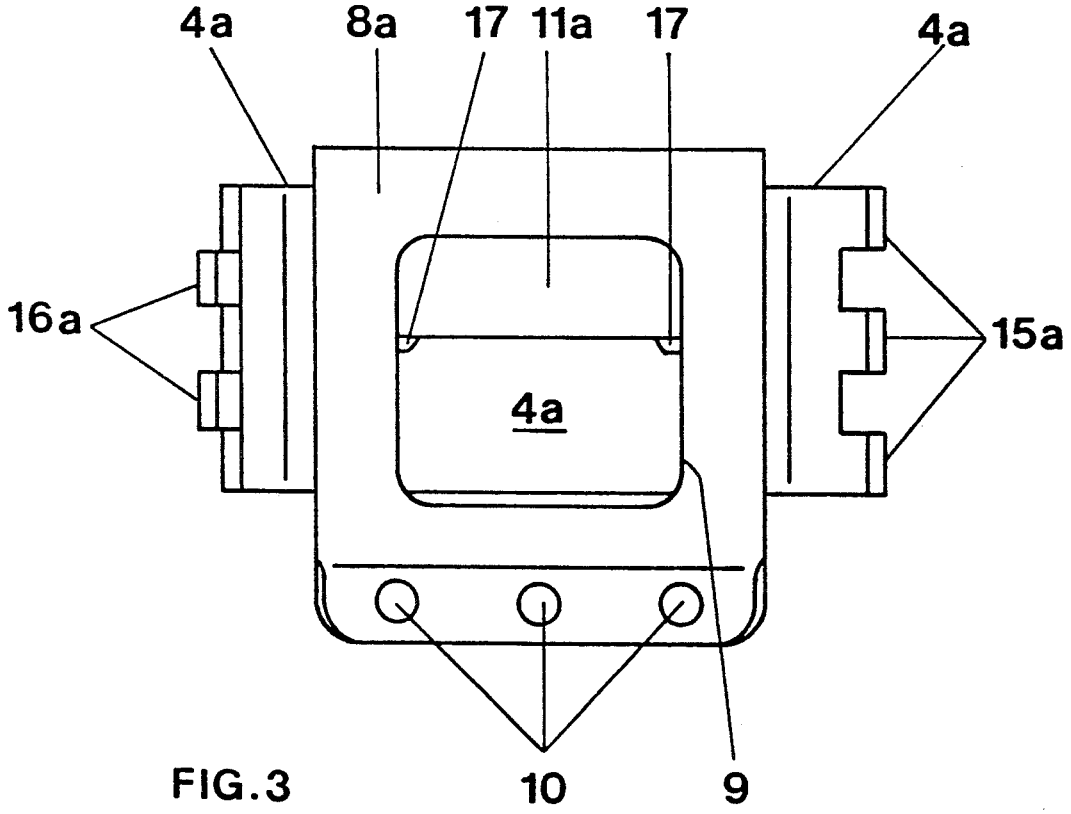
FIG. 3

FIG. 5
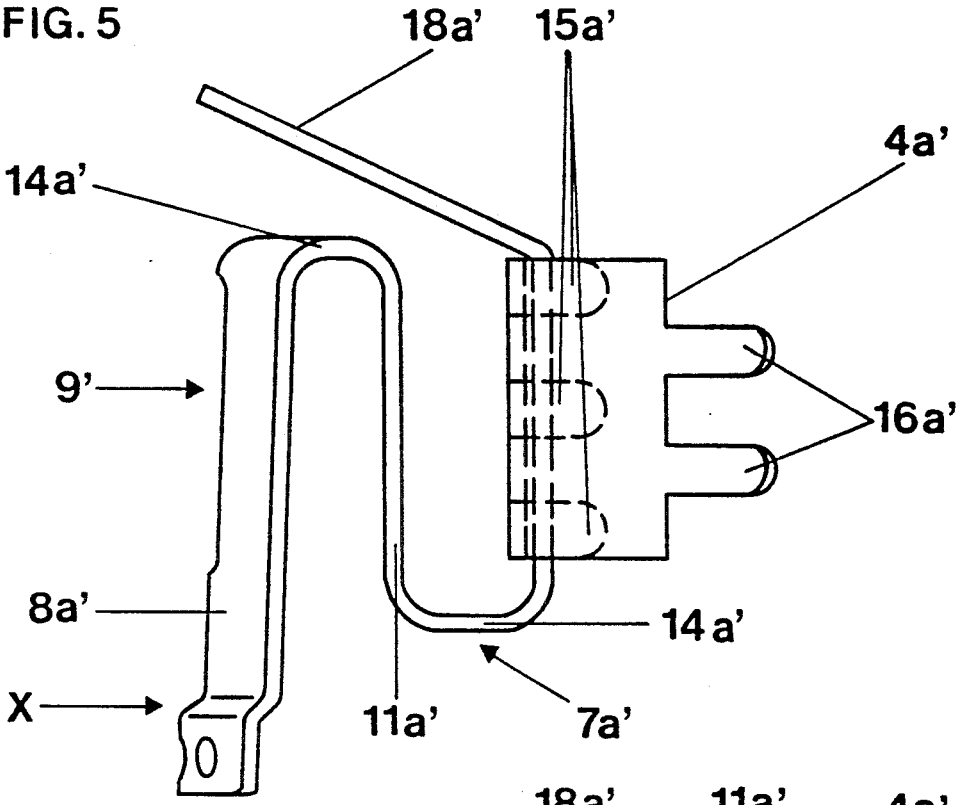
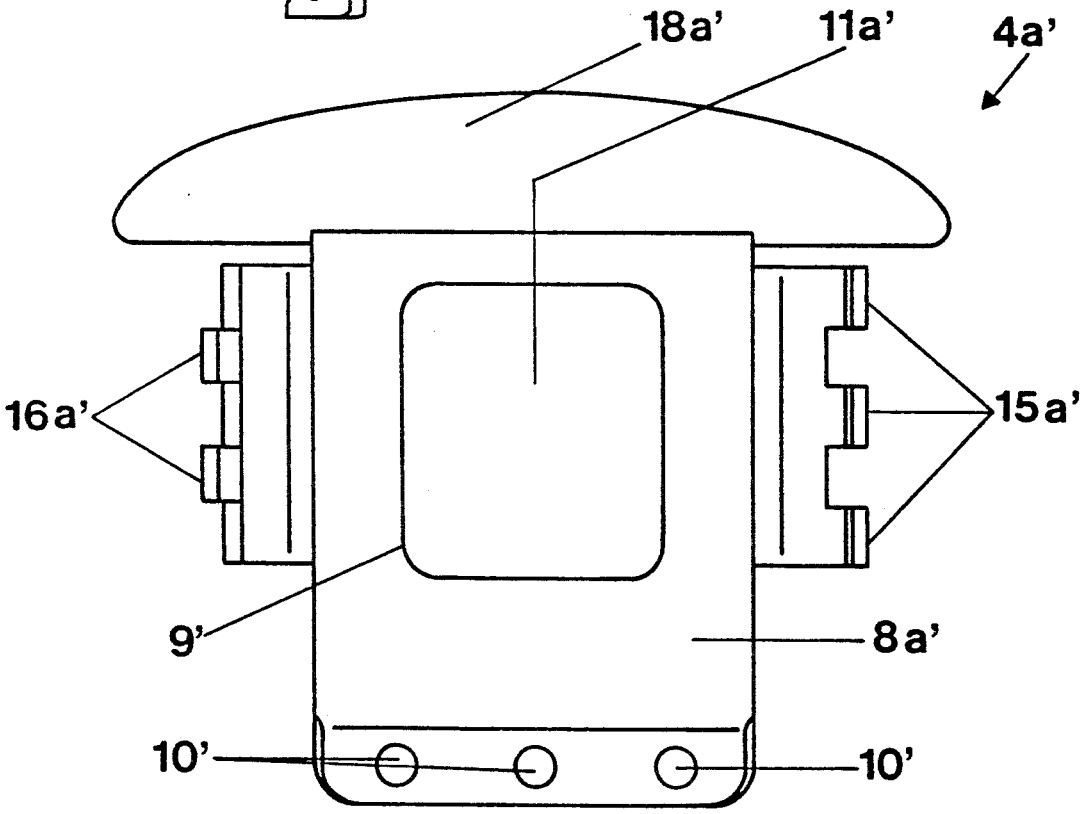
FIG. 6

VIBRATION, SHOCK AND HEAT-RESISTANT LAMP-BASE COMBINATION STRUCTURE

Reference to related patent and application, the disclosures of which are hereby incorporated by reference, assigned to the assignee of the present application:

U.S. Pat. No. 4,751,421, by the inventors hereof.

U.S. Ser. No. 07/726/976, filed Jul. 8, 1991, Eckhardt et al.

FIELD OF THE INVENTION

The present invention relates to lamps, particularly for use in automotive vehicles which, hence, must be resistant to vibration and shock and which, further, permit the use of plastic base material which is sensitive to heat.

BACKGROUND

The referenced U.S. Pat. No. 4,751,421, Braun et al., describes a lamp of the type to which the present invention relates and which is suitable, for example, for use in automotive headlights. In use, and when installed in a vehicle, the lamps are subjected to vibration and shock, which may lead to damage of the filament supports. It is, therefore, important to ensure that the lamp is seated in the headlight in such a way that it is protected against the influence of vibration and shock. Lamps of this type, particularly during extended operation, may generate high temperatures, which are transmitted to the base of the lamp. The base of the lamp usually includes a plastic base element. Plastic used in the base element may, if subjected to excessive heat, cause vapors to emanate therefrom, which may result in deposits on the reflector of the headlight, and undesirably affect the light output of the headlight.

THE INVENTION

It is an object to improve the lamp of the type described in the aforementioned patent by even better protecting the filament support against the effects of shock and vibration and which further reduces the operating temperature which arises at the plastic base structure, so that vapor emission from the plastic material is effectively inhibited.

Briefly, the bulb formed with the customary pinch seal is held by an attachment element on a plastic base structure, in which the attachment element is formed, for example of two halves, joined together, and clipped around the pinch seal of the lamp. The attachment element is constructed to hold the lamp in position by providing a cuff around the lamp when e.g. the half sections are assembled together. Flange or skirt portions, formed on the attachment element, are then attached to the base.

In accordance with a feature of the invention, a heat dissipating and shock absorbing portion connects the cuff portion and the flange portion. The heat dissipating and shock absorbing portion has a linear extent which is longer than the radial distance between the cuff portion and the flange portion, for example by being formed into an indulating shape, for example in U, S, or other extended form, so that the connecting heat dissipation and shock absorbing portion provides for damping of vibrations and shock, while furnishing an extended surface for improved heat dissipation.

The attachment element, preferably, is a unitary structure made of steel, which conduct heat relatively poorly. It is suitably stamped and bent to form, respectively, the cuff portion, the flange of skirt portion, and the connecting portion which provides for the vibration damping, shock absorbing and heat dissipating effect.

Basically, the carrier element which connects the lamp bulb or, rather, the pinch seal thereof, to the plastic base element, and forms the attachment element, is so constructed that, at the same time, it includes the portion which has the heat dissipation and shock absorbing effect. These elements can be bent backwardly with respect to the flange or skirt portion and/or the cuff, respectively. This substantially increases the elasticity of the overall structure of the attachment element and reduces the transfer of shock and vibration from the base, which is coupled to the chassis of the vehicle, to the lamp bulb itself. This decreases the danger of damage to the bulb. Heat transmission by the skirt or flange portion can be further reduced by punching openings therein, so that the cross-sectional area of heat conductive material, typically special steel, is reduced to such an extent that the operating temperature at the base, typically of plastic, is lower than before.

In accordance with a feature of the invention, shield elements can be secured to or attached or formed on the cuff portion of the attachment element of the lamp, extending above the attachment element, to prevent any heat radiating paths between the lamp and the base body itself and, consequently, also between the lamp and the connecting portion, thus contributing further to the ability to radiate heat therefrom, since direct exposure to heat radiation from the lamp is inhibited.

The arrangement is particularly suitable when the base body is made of plastic material, which has a tendency to emit particles of vapors upon being subjected to increased temperature, although, of course, the structure is suitable with base bodies of any material.

The attachment element can be made of two identical half sections or portions. This simplifies manufacture. The portions can be assembled by merely bending together suitably formed tabs, which interlock, after assembly.

DRAWINGS

FIG. 2 is a side view of a connecting element;

FIG. 3 is a front view of the connecting element, taken in the direction of the arrow X of FIG. 2;

FIG. 5 is a side view, similar to FIG. 2, of a half section and illustrating another embodiment and an additional feature; and FIG. 6 is a front view, taken in the direction of the arrow X of FIG 5 of the attachment element illustrated in FIG. 5.

DETAILED DESCRIPTION

Figure 1:
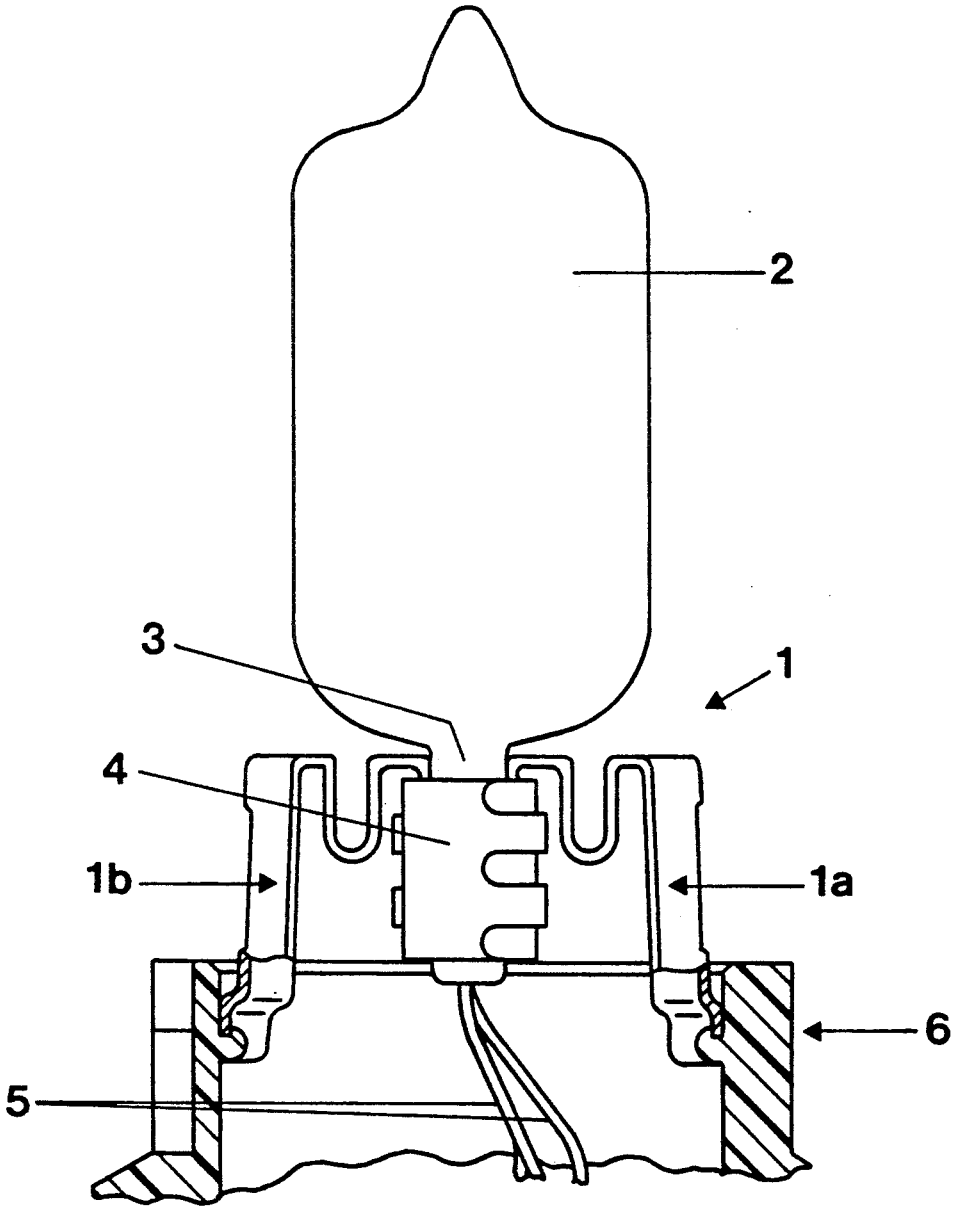
FIG. 1 is a side view of a halogen incandescent lamp secured to a plastic base by the connecting element in accordance with the present invention.

A halogen incandescent lamp 2, for example of the dual filament type, is secured by an attachment element 1 to a plastic base 6, as best seen in FIG 1. The lamp bulb 2 has a pinch seal 3. The pinch seal 3 is secured in a holder cuff 4, which forms a portion of the attachment element 1. Three current supply leads 5 extend from the pinch seal 3 of the lamp, and pass through the plastic base 6 in any suitable manner, as well known, and not further shown.

The attachment element 1 in the embodiment shown and similar to the structure of the referenced U.S. Pat. No. 4,751,421, is formed of two halves 1*a*, 1*b*. FIGS. 2 and 3 illustrate one half, only; the halves are identical. Each half of the attachment element or carrier for the lamp has a cuff portion 4*a*, 4*b*. A connecting portion 7*a*connects the cuff portion 4*a* to a flange or skirt portion 8*a*, 8*b*. A similar connecting portion is formed on cuff portion 4*b*. Preferably, the attachment element is a unitary punched sheet-metal structure which is then shaped and deformed. The sheet-metal structure is made of special steel. Special steel conducts heat only relatively poorly. The flange or skirt portions 8*a*, 8*b* are formed with an opening 9 therein extending over a major portion of the surface of the respective flange or skirt portion 8*a*, 8*b*. The flange or skirt portions are further formed with holes 10 at the bottom thereof in order to attach the flange portions to the plastic base, for example by high-frequency heating or high-frequency welding, which causes the plastic to permeate the holes 10 and harden therein.

In accordance with a feature of the invention, the connecting portion 7*a* is formed with a damping portion 11*a* to absorb and suppress mechanical shocks and vibration; the damping portion 11*a* likewise is made of special steel. Specialty steel is relatively poorly heat conductive. The damping portion 11*a*, as best seen in FIG. 2 with respect to a first embodiment, is formed of a generally U-shaped portion having two legs 12*a*, joined by a bottom or coupling rounded portion 13*a*. Two further strip elements 14*a* connect the U-legs 12*a*, respectively, to the cuff portion 4*a* and the skirt or flange portion 8*a*. Together with the bottom bent section 13*a*, the two connecting legs 12*a* have a generally U-shaped profile, in which the legs are formed by the regions 12*a*, and the region 13*a* forms the bottom of the U. The two leg portions 12*a* are spaced from each other by about 1.5 mm; their length is about half the height of the cuff portion 4*a*, as seen in FIG. 2.

The sheet metal, of which the attachment element 1 is formed, has a thickness which is uniformly about 0.5 mm. The width of the damping portion 11*a* and the width of the cross connecting portions 14*a* and of the skirt portions 8*a*, 8*b* corresponds, roughly, to the width of the pinch seal 3 of the lamp bulb 2. A damping element identical to element 11*a* is formed on the connecting portion of cuff portion 4*b*.

As can be clearly seen from FIG. 2, the distance along the structure between the left side of the cuff portion 4*a* (FIG. 2) and the skirt or flange portion 8*a* is substantially less than the linear extent of this distance. Thus the surface of the combined portions 14*a*, 12*a* and 13*a*, provides an extended heat radiating and heat dissipating surface. At the same time and due to the undulating configuration (see FIG. 2), the cuff portion 4*a*, which retains pinch seal 3 of the buld 2, is isolated with respect to vibration and shock transmitted from the base 6 to the flange or skirt portion 8*a*.

Figure 4:
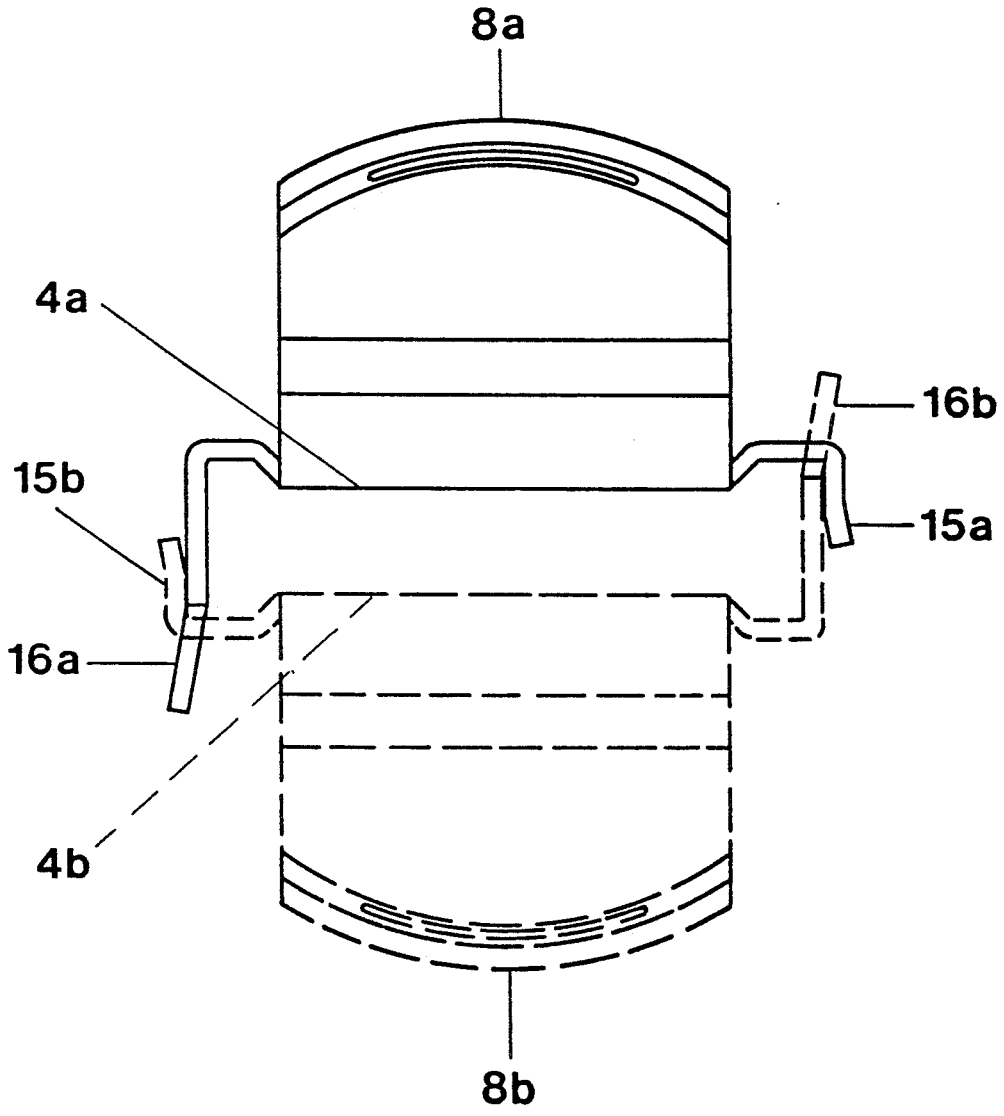
FIG. 4 is a bottom view, looking upwardly, from the underside of the attachment element, in which one half section is shown in full lines and the other half section in broken lines for ease of visualization.

Each one of the halves of the cuff portion 4*a*, 4*b* can be considered to have the shape of two fitting side walls of a rectangular block and forming an enclosing cuff or collar. Extending triple tongues 15*a* and 15*b* are, respectively, forced on one side of the cuff portion, and double tongued 16*a*, 16*b*, interlaced in the gaps between the triple tongues 15*a*, 15*b*, respectively, extend from the other end. The triple tongues 15*a* are shown in FIG. 2 in broken-line form since, in a side view, they are covered by the visible wall of the cuff half 4*a*. For assembly of the attachment element 1 to the lamp, the two half sections are joined together in such a way that the dual tongues 16*a* interlace in the spaces between the triple tongues 15*b* of an opposite half cuff, as best seen in FIG. 4, which illustrates the arrangement before the elements are completely clamped together, and without the lamp.

After insertion of the lamp, the tongues 15*a*, 15*b*, 16*a*, 16*b* are bent over and securely connected together to form an essentially elongated block-shaped cuff around the pinch seal 3 of the lamp 2. To securely hold the lamp in position, the walls of the cuff are formed with notches or recesses 17, positioned and dimensioned to receive holding projections formed on the pinch seal of the lamp.

EMBODIMENT OF FIGS. 5 AND 6

The difference between this embodiment and that of FIGS. 1–4 is merely the way in which the heat dissipation and shock absorption portions are formed. Thus, the portions 7*a*′ are formed by a bent-back element 11*a*′, joined in U-shaped relation to the skirt 8*a*′, and then coupled through a somewhat elongated lower U-section 14*a*′ directly to the cuff portion 4*a*′. The length of the elements 11*a*′ corresponds, generally, to about the height of the cuff portion 4*a*′. The length of the connecting portion 14*a*′ is about 3.5 mm; the material can be the same as in the embodiments of FIGS. 1–3, namely specialty steel of the about 0.5 mm, which is uniform for all the portions of the attachment element.

FIGS. 5 and 6 illustrate a further feature which may be used with the embodiment of FIGS. 1–4 equally as with FIGS. 5 and 6, namely the addition of an essentially flat shielding strip 18*a*′. This shielding strip prevents a direct radiation path for heat from the lamp to the plastic base 6 which, although omitted from FIG. 5, would be placed at the bottom of the flange or skirt portion 8*a*′. The shields 18*a*′ and a similar shield of the other half-section—not shown, since the two half-sections can be identical—not shown, since the two half-sections can be identical—each have approximately the shape of a half-ellipse. They are formed or punched out of the same sheet element as the cuff portion 4*a*′ at the edge facing the lamp bulb 2. They are bent upwardly at an angle of about 25° with respect to a plane perpendicular to the lamp axis, that is, form with the lamp axis an angle of about 65°, bent upwardly from the upper edge of the cuff. They can be unitary with the attachment element.

Various changes and modifications may be made, and features described herein with respect to any embodiment may be used with any of the others, within the scope of the inventive concept.

We claim:

1. A shock, vibration and heat-resistant electric lamp-base structure, having a bulb (2) having a pinch seal (3);

a base structure (6) of insulating material; and an attachment element (1) mechanically connecting the bulb to the base, said attachment element including two half-sections, each half-section having a cuff portion (4*a*, 4*b*) engaged against said pinch seal (3) of the bulb (2) upon connecting together of said half-sections, and holding the pinch seal between the cuff portions of the half-sections, and a flange or skirt portion (8*a*, 8*b*) engaged against and secured to the base structure (6); and comprising an arrangement to thermally separate the bulb (2) from the base structure (6) and further provide for damping of vibration and shock transmitted to the bulb from the base structure, said arrangement including said half-sections, wherein each of said half-sections forms a heat dissipating and shock absorbing portion defining a connecting portion (7; 11, 12, 13, 14) connecting said cuff portion (4*a*, 4*b*) and said flange or skirt portion (8*a*, 8*b*), said connecting portion having a length which is greater than a radial distance between the cuff portion (4*a*, 4*b*) and the flange or skirt portion (8*a*, 8*b*) at the region of engagement with the base structure (6) to provide for damping of vibration and shock and radiation of heat from the lamp.

2. The structure of claim 1, wherein said connecting portion (7; 11, 12, 13, 14) comprises a coupling section (7) and a damping and heat radiation dissipating section (11, 12, 13), said sections forming a unitary sheet-metal structure.

3. The structure of claim 1, wherein said cuff portion (4*a*, 4*b*), said flange or skirt portion (8*a*, 8*b*) and said connecting portion (7; 11, 12, 13, 14) are a unitary sheet-metal element.

4. The structure of claim 1, wherein said connecting portion comprises a first region (12*a*; 11*a*') bent backwardly with respect to the flange or skirt portion from an edge remote from said base structure (6) and a connecting region (12*a*, 14*a*; 14*a*') coupling said first region to the cuff portion (4*a*, 4*b*).

5. The structure of claim 4, wherein said connecting region comprises a second region bent in a direction parallel to said flange or skirt portion and forming, together with said first region, a generally U-shaped structure, said second region being connected to said cuff portion at an edge thereof adjacent the bulb (2) of the lamp.

6. The structure of claim 4, wherein said connecting region comprises an essentially radially positioned sheet-metal portion.

7. The structure of claim 5, wherein said connecting region (14*a*') is connected to the cuff portion (4*a*) at an edge thereof remote from said bulb (2).

8. The structure of claim 4, wherein the width of said connecting portion is approximately the same as the width of the pinch seal (3) of the bulb.

9. The structure of claim 4, wherein said connecting portion includes a sheet-metal portion bent over in U shape from a region of the flange or skirt portion remote from said base structure.

10. The structure of claim 4, wherein said connecting region comprises a sheet-metal element bent over from an edge of the flange or skirt portion (8*a*, 8*b*) remote from said base structure, twice in generally U configuration.

11. The structure of claim 1, wherein said flange or skirt portions (i*a*, 8*b*) are formed with at least one opening (9) to reduce the cross-sectional area thereof transmitting heat between the cuff portion and the base structure.

12. The structure of claim 1, wherein said two half-sections are identical.

13. The structure of claim 1, wherein said base structure (6) comprises plastic material.

14. The structure of claim 1, including shield elements (18*a*') extending from a region of the cuff portion (4*a*, 4*b*), adjacent the bulb (2) for inhibiting direct heat transmission from said bulb (2) to said heat dissipation and shock absorbing portion (7, 11, 12, 13, 14).

15. A shock, vibration and heat-resistant electric lamp-base structure, having a bulb 2 having a pinch seal (3);

a base structure (6) of insulating material; and an attachment element (1) mechanically connecting the bulb to the base structure, said attachment element including a cuff or collar portion fitting about said pinch seal (3), engaged against said pinch seal (3) of the bulb (2) and holding the pinch seal within said cuff or collar portion, and at least one flange or skirt portion engaged against and secured to the base structure (6); and comprising an arrangement to thermally separate the bulb (2) from the base structure (6) and further provide for damping of vibration and shock transmitted to the bulb from the base structure, wherein said attachment element comprises poorly heat-conductive steel; and the attachment element further includes a heat dissipating and shock absorbing portion forming a connecting portion (7; 11, 12, 13, 14) connecting said cuff portion and said flange or skirt portion, said connecting portion having a length which is greater than a radial distance between the cuff portion and the flange or skirt portion at the region of engagement with the base structure (6) to provide for damping of vibration and shock and radiation of heat from the lamp.

16. The structure of claim 15, wherein said connecting portion (7; 11, 12, 13, 14) comprises a coupling section (7) and a damping and heat radiating section (11, 12, 13), said sections forming a unitary sheet-metal structure.

17. The structure of claim 15, wherein said connecting portion comprises a first region (12*a*; 11*a*') bent backwardly with respect to the flange or skirt portion from an edge remote from said base structure (6) and a connecting region (12*a*, 14*a*; 14*a*') coupling said first region to the cuff portion (4*a*, 4*b*).

18. The structure of claim 17, wherein said connecting region comprises a second region bent in a direction parallel to said flange or skirt portion and forming, together with said first region, a generally U-shaped structure, said second region being connected to said cuff portion at an edge thereof adjacent the bulb (2) of the lamp.

19. The structure of claim 15, including shield elements (18*a*') extending from a region of the cuff portion (4*a*, 4*b*), adjacent the bulb (2) for inhibiting direct heat transmission from said bulb (2) to said heat dissipation and shock absorbing portion (7; 11, 12, 13, 14).

20. The structure of claim 15, wherein said base structure (6) comprises plastic material.

* * * * *